US009777228B2

(12) United States Patent
Davydov

(10) Patent No.: US 9,777,228 B2
(45) Date of Patent: Oct. 3, 2017

(54) PROCESS FOR CRACKING HYDROCARBONS TO MAKE DIESEL

(71) Applicant: UOP LLC, Des Plaines, IL (US)

(72) Inventor: Lev Davydov, Northbrook, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 15/145,580

(22) Filed: May 3, 2016

(65) Prior Publication Data

US 2017/0002274 A1 Jan. 5, 2017

Related U.S. Application Data

(60) Provisional application No. 62/186,864, filed on Jun. 30, 2015.

(51) Int. Cl.
*C10G 51/06* (2006.01)
*C10G 51/00* (2006.01)

(52) U.S. Cl.
CPC ..... *C10G 51/06* (2013.01); *C10G 2300/1077* (2013.01); *C10G 2300/4081* (2013.01)

(58) Field of Classification Search
CPC C10G 51/00; C10G 51/06; C10G 2300/1077; C10G 2300/4081
See application file for complete search history.

(56) References Cited

U.S. PATENT DOCUMENTS 3,748,251 A 7/1973 Demmel et al.
4,436,613 A 3/1984 Sayles
4,615,996 A * 10/1986 Occelli ..... B01J 29/06 208/120.01
7,220,351 B1 5/2007 Pontier et al.
7,312,370 B2 12/2007 Pittman et al.
7,611,622 B2 11/2009 Niccum et al.
8,864,979 B2 10/2014 Palmas
8,894,840 B2 11/2014 Leonard et al.
2003/0121825 A1* 7/2003 Pittman ..... C10G 11/18 208/113
2010/0155293 A1* 6/2010 Verstraete ..... C10G 45/08 208/49
2013/0001130 A1 1/2013 Mo
2013/0168289 A1* 7/2013 Saidulu ..... B01J 8/0055 208/73

FOREIGN PATENT DOCUMENTS

EP 1050572 A2 11/2000

OTHER PUBLICATIONS

Mandal, "Effect of Coke on Catalysts in Distillate FCC Unit Performance", Ind. Eng. Chem. Res. 1993, 32, 1018-1023.

* cited by examiner

*Primary Examiner* — Brian McCaig

(57) ABSTRACT

A process and apparatus is for recycling HCO and/or naphtha from a first FCC unit to a second FCC unit to recover additional distillate and/or light olefins. A first catalyst stream for the first FCC unit may be isolated from a second catalyst stream for the second FCC unit. Fractionation of second cracked products from the second FCC unit may be separate from fractionation of first cracked products from the first FCC unit.

17 Claims, 2 Drawing Sheets

PROCESS FOR CRACKING HYDROCARBONS TO MAKE DIESEL

CROSS-REFERENCE TO RELATED APPLICATION

This application claims priority from Provisional Application No. 62/186,864 filed Jun. 30, 2015, the contents of which are hereby incorporated by reference

BACKGROUND OF THE INVENTION

The field of the invention is fluid catalytic cracking (FCC).

FCC technology, now more than 50 years old, has undergone continuous improvement and remains the predominant source of gasoline production in many refineries. This gasoline, as well as lighter products, is formed as the result of cracking heavier, less valuable hydrocarbon feed stocks such as gas oil.

In its most general form, the FCC process comprises a reactor that is closely coupled with a regenerator, followed by downstream hydrocarbon product separation. Hydrocarbon feed contacts catalyst in the reactor to crack the hydrocarbons down to smaller molecular weight products. During this process, coke tends to accumulate on the catalyst which is burned off in the regenerator.

Naphtha is most plenteously produced in an FCC unit and is made into gasoline when lighter hydrocarbons are removed. LPG is a lighter hydrocarbon produced in an FCC unit which may contain valuable light olefins that can be recovered. Light cycle oil (LCO) is a heavier hydrocarbon stream produced in an FCC unit that can be directed to the diesel pool. Heavy cycle oil (HCO) is an even heavier FCC liquid stream pumped around to cool the main fractionation column but is typically not recovered as product. Slurry oil is the heaviest FCC product that is typically burned as fuel after catalyst is removed from it.

The demand for diesel has increased over gasoline in recent years. Increased recovery of LCO produced in an FCC unit can be directed to the diesel pool and augment diesel production.

Demand for propylene continues to outstrip supply. Further recovery of light olefins would also be desirable.

SUMMARY OF THE INVENTION

A process embodiment comprises a process for catalytically cracking hydrocarbons comprising contacting a first hydrocarbon feed stream with a first FCC catalyst in a first FCC reactor to provide a first cracked stream. A second hydrocarbon feed stream is contacted with a second FCC catalyst in a second FCC reactor to provide a second cracked stream. The second FCC catalyst comprises a greater proportion of MFI zeolite than the first FCC catalyst. The first cracked stream is fractionated to provide a heavy cycle oil stream which is recycled in the second hydrocarbon feed stream.

An additional process embodiment comprises a process for catalytically cracking hydrocarbons comprising contacting a first hydrocarbon feed stream with a first FCC catalyst in a first FCC reactor to provide a first cracked stream. A second hydrocarbon feed stream is contacted with a second FCC catalyst in a second FCC reactor to provide a second cracked stream. The second FCC catalyst comprises a greater proportion of MFI zeolite than the first FCC catalyst. The first cracked stream is fractionated to provide a heavy cycle oil stream and a cracked naphtha stream which are both recycled in the second hydrocarbon feed stream.

A further process embodiment comprises a process for catalytically cracking hydrocarbons comprising contacting a first hydrocarbon feed stream with a first FCC catalyst in a first FCC reactor to provide a first cracked stream. The first FCC catalyst is disengaged from the first cracked stream. A first portion of the first FCC catalyst is regenerated, and a second portion of the first FCC catalyst is recycled to be contacted with the first hydrocarbon feed stream without undergoing regeneration. A second hydrocarbon feed stream is contacted with a second FCC catalyst in a second FCC reactor to provide a second cracked stream. The second FCC catalyst comprises a greater proportion of MFI zeolite than the first FCC catalyst. The first cracked stream is fractionated to provide a heavy cycle oil stream which is recycled in the second hydrocarbon feed stream.

Additional features and advantages of the invention will be apparent from the description of the invention, figures and claims provided herein.

DEFINITIONS

Figure 1:
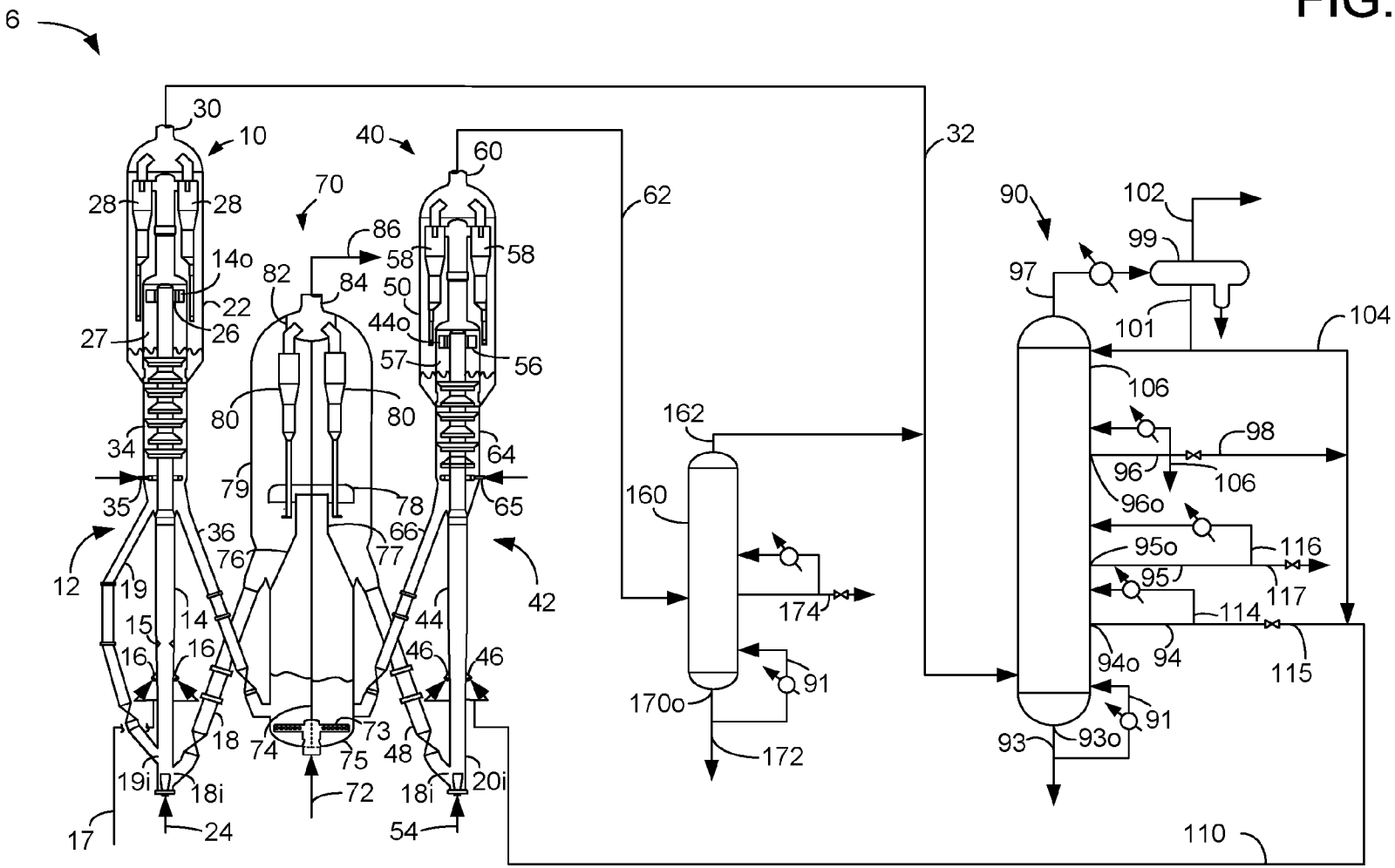
FIG. 1 is a schematic drawing of an FCC unit.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "bypass" means that the object is out of downstream communication with a bypassing subject at least to the extent of bypassing.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of any reflux or reboil to the column. Stripping columns omit a reboiler at a bottom of the column and instead provide heating requirements and separation impetus from a fluidized inert media such as steam.

As used herein, the term "True Boiling Point" (TBP) or "TBP method" means a test method for determining the boiling point of a material which corresponds to ASTM D-2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "T5" or "T95" means the temperature at which 5 volume percent or 95 volume percent, as the case may be, respectively, of the sample boils using ASTM D-86.

As used herein, the term "initial boiling point" (IBP) means the temperature at which the sample begins to boil using ASTM D-86.

As used herein, the term "end point" (EP) means the temperature at which the sample has all boiled off using ASTM D-86.

As used herein, the term "diesel cut point" is between about 343° C. (650° F.) and about 399° C. (750° F.) using the TBP method.

As used herein, the term "diesel boiling range" means hydrocarbons boiling in the range of between about 132° C. (270° F.) and the diesel cut point using the TBP method.

As used herein, the term "diesel conversion" means conversion of feed that boils above the diesel cut point to material that boils at or below the diesel cut point in the diesel boiling range.

As used herein, the term "FCC conversion" means conversion of feed that boils above 221° C. (430° F.) to material boiling below 221° C. (430° F.).

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator that may be operated at higher pressure.

As used herein, the term "predominant" or "predominate" means greater than 50%, suitably greater than 75% and preferably greater than 90%.

DETAILED DESCRIPTION

Refiners currently seek to revise the typical yield distribution from their FCC units to reduce gasoline production and increase light olefin and distillate production due to shifting market demand. Increasing diesel and light olefins over gasoline is difficult to accomplish in a single reaction zone of a conventional single-riser FCC unit.

A dual riser FCC unit is proposed to achieve the bimodal yield distribution of LCO and propylene. The main FCC riser will operate at low severity to maximize the yield of LCO. Large amounts of slurry oil will be produced as well which is undesired. Hence, a recycle stream of HCO may be fed to a second FCC riser. At the same time, naphtha may also be recycled to the second FCC riser. The HCO and the naphtha will crack at high severity in the second riser, producing LCO and heavy naphtha from the HCO and light olefins from the naphtha. To improve the yield of LCO in the main riser, a low zeolite-to-matrix catalyst may be used with increased bottoms-cracking activity. To improve yields of light olefins in the second riser a high-propylene producing, ZSM-5 catalyst may be used.

Both catalyst streams and effluent streams from the main riser and second riser may be kept separate by using separate reactor vessels and fractionators for the first and second risers as well as the compartmentalization of the catalyst regenerator. Regenerator compartmentalization enables the ZSM-5 containing portion of the catalyst to circulate in a separate loop, thus limiting the exposure of the main first hydrocarbon feed to ZSM-5 catalyst which would reduce the yield of LCO as well as coke selectivity if allowed to circulate in the first FCC riser.

An embodiment of process 6 is illustrated in FIG. 1, wherein like numerals designate like components. The process 6 is equipped for processing a first hydrocarbon feed stream. The apparatus and process 6 generally include a first FCC unit 10, a second FCC unit 40, a regenerator 70, a main fractionation column 90 and a second fractionation column 160.

The first FCC unit 10 includes a first FCC reactor 12 comprising a first riser 14. A conventional FCC feedstock is suitable first hydrocarbon feed stream. The most common of such conventional fresh hydrocarbon feedstocks is a "vacuum gas oil" (VGO), which is typically a hydrocarbon material having a boiling range with an IBP of at least about 232° C. (450° F.), a T5 of at least about 288° C. (550° F.) to about 343° C. (650° F.), a T95 between about 510° C. (950° F.) and about 570° C. (1058° F.) and an EP of no more than about 626° C. (1158° F.) prepared by vacuum fractionation of atmospheric residue. Such a fraction is generally low in coke precursors and heavy metal contamination which can serve to contaminate catalyst. Atmospheric residue is a preferred feedstock boiling with an IBP of at least about 315° C. (600° F.), a T5 between about 340° C. (644° F.) and about 360° C. (680° F.) and a T95 of between about 700° C. (1292° F.) and about 900° C. (1652° F.) obtained from the bottoms of an atmospheric crude distillation column. Atmospheric residue is generally high in coke precursors and metal contamination. Other heavy hydrocarbon feedstocks which may serve as a first hydrocarbon feed stream include heavy bottoms from crude oil, heavy bitumen crude oil, shale oil, tar sand extract, deasphalted residue, products from coal liquefaction, and vacuum reduced crudes. A suitable first hydrocarbon feed stream also includes mixtures of the above hydrocarbons and the foregoing list is not exhaustive.

In the first FCC reactor 12 the first hydrocarbon feed stream in the first FCC feed line 17 is contacted with a first FCC catalyst stream. Specifically, in an embodiment, a regenerated first FCC catalyst stream entering from a regenerator conduit 18 is contacted with the first hydrocarbon feed stream fed through distributors 16 into the first FCC riser 14. The regenerator conduit 18 is in downstream communication with the regenerator 70. The first FCC riser 14 has an inlet **18*i* in downstream communication with the regenerator conduit 18. The regenerator conduit 18 is connected to the FCC riser 20** at a lower end.

The first FCC catalyst stream can be a single catalyst or a mixture of different catalysts comprising a first catalyst. Generally, the first catalyst may include any of the well-known catalysts that are used in the art of FCC, such as an active amorphous clay-type catalyst and/or a high activity, crystalline molecular sieve. Zeolites may be used as molecular sieves in FCC processes. Typically, the zeolitic molecular sieves appropriate for the first catalyst have a large average pore size. Usually, molecular sieves with a large pore size have pores with openings of greater than about 0.7 nm in effective diameter defined by greater than about 10, and typically about 12, member rings. Pore Size Indices of large pores can be above about 31. Suitable large pore zeolite catalysts may include synthetic zeolites such as X and Y zeolites, mordenite and faujasite. The zeolite can have any suitable amount of a rare earth metal or rare earth metal atoms in oxide form.

Preferably, the first catalyst includes a large pore zeolite, such as a Y-type zeolite and a matrix material comprising an active alumina material, a binder material, including either silica or alumina, and an inert filler such as kaolin. Preferably, the first FCC catalyst stream comprises a first catalyst comprising a low ratio of zeolite to matrix material that has an increased bottoms-cracking activity due to the active alumina in the matrix. The ratio of zeolite to matrix of the first catalyst in the first FCC catalyst stream should be no more than 2. Other suitable first FCC catalysts include Amber from Albemarle Corporation located in Baton Rouge, La., Stamina from BASF Corporation from Iselin, N.J. or Midas from WR Grace and Co. from Columbia, Md.

Ensuring that the cracking catalyst has sufficient coke on catalyst when it contacts the hydroprocessed feed stream will operate to maximize the yield of diesel in the FCC product. Increasing coke on catalyst can be achieved by recycling spent catalyst that has not undergone regeneration to the FCC reactor as part of the first FCC catalyst stream. In an aspect, regenerated catalyst from regenerator conduit 18 and spent cracking catalyst entering from a recycle catalyst conduit 19 are contacted with the first hydrocarbon feed stream in a first riser 14 of the first FCC reactor 12. The spent catalyst will increase the coke concentration of catalyst in the FCC reactor 12.

The recycle of spent catalyst through the recycle catalyst conduit 19 can also be used to increase the ratio of catalyst-to-oil in the reactor to a total catalyst-to-oil ratio of about 8 to about 20 and preferably about 11 to about 18. We have found that coke on recycled catalyst between 0.7 and about 1.1 and preferably above 0.99 can increase selectivity to LCO from the FCC reactor 12 by up to 2.2 wt %. By using spent catalyst recycle, the fraction of spent catalyst recycled to the riser can comprise between about 10 and about 50 wt % of the first catalyst stream in the first FCC riser 14 of the FCC reactor 12, preferably between about 13 and about 48 wt %. The average coke on the blend of spent and regenerated catalyst in the first catalyst stream in the first FCC riser 14 may range between about 0.1 and about 0.6 wt %, preferably between about 0.1 and about 0.5 wt %. The recycle conduit 19 is in downstream communication with a riser outlet 14*o*. A riser inlet 19*i* is in downstream communication with the recycle conduit 19 at an outlet end of the recycle conduit 19. The recycle conduit 19 is connected to the riser 14 at the outlet end of the recycle conduit. The recycle conduit 19 bypasses the regenerator 70 by being in downstream communication with the riser outlet 14*o* and the riser inlet 19*i* being in direct, downstream communication with the recycle conduit. Consequently, spent catalyst entering the recycle conduit 19 passes back to the riser 14 before any of it enters the regenerator 70. The recycle conduit 19 has no direct communication with the regenerator 70.

Due to the high flow rate of catalyst in the first FCC riser 14, protrusions 15 may be installed on a wall of the riser extending inwardly into the riser to urge catalyst away from the wall of the riser toward the center of the riser where the feed may be more concentrated.

The first FCC riser 14 extends upwardly to the bottom of a reactor vessel 22. The contacting of feed and catalyst is fluidized by gas from a fluidizing line 24. Heat from the catalyst vaporizes the first hydrocarbon feed stream which cracks to lighter molecular weight hydrocarbons in the presence of the first FCC catalyst stream as both are transferred up the first FCC riser 14 into the first reactor vessel 22. The first FCC reactor 12 produces conventional cracked products such as gasoline but also produces increased LCO due to the increased concentration of coke on catalyst and the active alumina in the matrix. The cracked stream of hydrocarbon products and spent catalyst in the riser 14 are thereafter discharged from the riser outlet 14*o* into a disengaging chamber 27 which contains the riser outlet. The cracked stream of hydrocarbon products is disengaged from the cracking catalyst in the disengaging chamber 27 using a rough cut separator 26. Cyclonic separators which may include one or two stages of cyclones 28 in the reactor vessel 22 further separate catalyst from cracked hydrocarbon products. A cracked stream of product gases exits the reactor vessel 22 through a product outlet 30 to first product line 32 for transport to a main fractionation column 90. The first FCC reactor 42 should be operated at low severity to achieve about 45 to about 70 wt % FCC conversion and preferably about 50 to about 65 wt % FCC conversion to achieve higher selectivity to LCO and gasoline. The outlet temperature of the first cracked products leaving the riser 14 should be between about 482° C. (900° F.) and about 538° C. (1000° F.).

Inevitable side reactions occur in the riser 14 leaving coke deposits on the catalyst that lower catalyst activity. The spent or coked catalyst requires regeneration to restore its activity. Coked catalyst, after separation from the gaseous cracked product hydrocarbons, falls into a stripping section 34 where steam is injected through a nozzle 35 and distributor to purge residual hydrocarbon vapor. After the stripping operation, a portion of the spent catalyst is fed to the catalyst regenerator 70 through a spent catalyst conduit 36. The catalyst regenerator 70 may be in downstream communication with the riser 14, specifically, the riser outlet 14*o*. Another portion of the spent catalyst is recycled through recycle catalyst conduit 19 to the riser 14 as previously described.

The first cracked stream is fractionated in the first FCC fractionation column 90. The gaseous cracked stream in line 32 is fed to a lower section of the main fractionation column 90. The main fractionation column 90 is in downstream communication with the first riser 14 and the first FCC reactor 12. Several fractions may be separated and taken from the main fractionation column 90 including a slurry oil stream from a bottom outlet 93*o* in line 93, a HCO stream is provided in line 94, a LCO stream is provided in line 95 that is recovered and an optional heavy naphtha stream in line 98. Naphtha and gaseous light hydrocarbons are removed in overhead line 97 from the main fractionation column 90 and condensed before entering a main column receiver 99. An aqueous stream is removed from a boot in the receiver 99. Moreover, a condensed naphtha stream is removed in bottoms line 101 while a gaseous light hydrocarbon stream is removed in overhead line 102. The gaseous light hydrocarbon stream in overhead line 102 may enter a vapor recovery section downstream of the first FCC fractionation column 90. A first portion of the light naphtha stream in bottoms line 101 may be refluxed to the main fractionation column 90. A second portion of the light naphtha stream in net line 104 may be recycled as a cracked naphtha stream in a second hydrocarbon stream to the second FCC unit 40 in a recycle line 110. A third portion of the light naphtha stream may be stabilized in the vapor recovery section to produce gasoline product, but this embodiment is not shown.

The main fractionation column 90 has a bottom outlet 93*o* in a bottom of the main fractionation column 90 from which a bottoms stream of slurry oil is taken. A portion of the slurry oil stream in line 93 may be cooled and recycled in line 91 back to the main fractionation column 90 to cool the man column. A portion or all of a second hydrocarbon stream in the recycle line 110 is taken from an outlet in a side of a main fractionation column.

A lowest side outlet 94*o* and a penultimate outlet 95*o* may be provided in the side 106 of the main fractionation column 90. The recycle line 110 may transport a recycle cracked stream comprising at least a portion of the HCO stream from the lowest side outlet 94*o* to a second FCC unit 40. The HCO stream is taken as a recycle cracked stream in line 94 from the lowest side outlet 94*o* in the side 106 of the main fractionation column 90 regulated by a control valve on line 115. A reflux HCO stream is taken in line 114 from line 94 cooled and returned to the main column 90 to cool the main column. The second FCC unit 40 is in downstream communication with the lowest side outlet 94*o*. By recycling an HCO stream to the second FCC unit 40, the yield of LCO may be increased in the FCC unit over a yield that would have been obtained without recycling the HCO stream. In an aspect, at least 5 wt %, suitably at least 50 wt %, preferably at least 75 wt % and up to all of the HCO in line 94 may be recycled to the second FCC unit 40.

An LCO stream may be taken in line 95 from the penultimate outlet 95*o* in the side 106 of the main fractionation column 92. An LCO product stream is taken in line 117 from line 95 at a flow rate regulated by a control valve on line 117. A recycle LCO stream is taken in line 116 from line 95 cooled and returned to the main column 90 to cool the main column.

An optional heavy naphtha stream in line 96 may be returned to the main fractionation column 90 after cooling while a heavy naphtha product stream is taken in line 106. A portion of the heavy naphtha stream in line 96 may be recycled in line 98 to the second FCC unit 40 via lines 98, 104 and 110 in an embodiment.

The light naphtha stream in line 101 preferably has an initial boiling point (IBP) in the $C_5$ range; i.e., between about 0° C. (32° F.) and about 35° C. (95° F.), a T5 between about 15° C. (59° F.) and 35° C. (95° F.), a T95 between about 120° C. (248° F.) and about 130° C. (266° F.) and an end point (EP) at a temperature greater than or equal to about 132° C. (270° F.). The optional heavy naphtha stream in line 96 has an IBP just above about 137° C. (270° F.), a T5 between about 20° C. (68° F.) and 40° C. (104° F.), a T95 between about 140° C. (284° F.) and about 180° C. (356° F.) and an EP at a temperature above about 204° C. (400° F.), preferably between about 200° C. (392° F.) and about 221° C. (430° F.). If no heavy naphtha stream is taken from the main column 90, the cracked naphtha stream will comprise a full naphtha fraction in line 104 having the IBP and the T5 given for the light naphtha stream and the T95 and the end point given for the heavy naphtha fraction. The LCO stream in line 95 has an IBP at about the EP temperature of the heavy naphtha if a heavy naphtha stream is taken or the full naphtha stream and an EP in a range of about 332° C. (630° F.) to about 360° C. (680° F.). The LCO stream may have a T5 in the range of about 213° C. (416° F.) to about 244° C. (471° F.) and a T95 in the range of about 354° C. (669° F.) to about 377° C. (710° F.). The HCO stream has an IBP just above the EP temperature of the LCO stream and an EP in a range of about 443° C. (820° F.) to about 500° C. (930° F.). The HCO stream may have a T5 in the range of about 332° C. (630° F.) to about 349° C. (660° F.) and a T95 in the range of about 382° C. (720° F.) to about 404° C. (760° F.). The slurry oil stream in line 93 has an IBP just above the EP temperature of the HCO stream and includes everything boiling at a higher temperature.

The recycle line 110 carries one, some or all of the HCO recycle stream from line 115, the light cracked naphtha stream in line 104 and optionally a heavy cracked naphtha stream in line 98 as a second hydrocarbon feed stream to a second FCC unit 40. The second FCC unit 40 is very similar to the first FCC unit 10, but with noted differences.

The second FCC unit 40 includes a second FCC reactor 42 comprising a second riser 44. The second hydrocarbon feed stream is contacted with a second FCC catalyst stream in the second FCC reactor 42 to provide a second cracked stream. Specifically, in an embodiment, a regenerated second FCC catalyst stream entering from a second regenerator conduit 48 is contacted with the second FCC feed stream fed through distributors 46 into the second FCC riser 44. The second regenerator conduit 48 is in downstream communication with the regenerator 70. The second regenerator conduit 48 is connected to the second FCC riser 44 at a lower end.

The second FCC catalyst stream can be a single catalyst or a mixture of different catalysts comprising the second catalyst as disclosed in, e.g., U.S. Pat. No. 7,312,370 B2. The second FCC catalyst stream may include the first catalyst described for the first FCC catalyst stream but if it is a zeolite, it may have a zeolite to matrix ratio that is higher than 2. The second catalyst may include a medium or smaller pore zeolite catalyst, such as a MFI zeolite, as exemplified by at least one of ZSM-5, ZSM-11, ZSM-12, ZSM-23, ZSM-35, ZSM-38, ZSM-48, and other similar materials. Other suitable medium or smaller pore zeolites include ferrierite, and erionite. Preferably, the second catalyst has the medium or smaller pore zeolite dispersed on a matrix including a binder material such as silica or alumina and an inert filler material such as kaolin. The second catalyst may also include some other active material such as Beta zeolite. These compositions may have a crystalline zeolite content of about 10 to about 50 weight percent (hereinafter may be abbreviated as "wt %") or more, and a matrix material content of about 50 to about 90 wt %. Second catalysts containing about 30 to about 50 wt % crystalline zeolite crystals are preferred, and those with greater crystalline zeolite content may be used. Generally, medium and smaller pore zeolites are characterized by having an effective pore opening diameter of less than or equal to about 0.7 nm, rings of about 10 or fewer members, and a Pore Size Index of less than about 31. Preferably, the second catalyst is an MFI zeolite having a silicon-to-aluminum ratio greater than about 15, preferably greater than about 75. In one exemplary embodiment, the silicon to aluminum ratio can be about 15 to about 35. ZMX available from Intercat in Manasquan, N.J. is a suitable second FCC catalyst.

The second FCC catalyst stream comprises a greater proportion of medium or smaller pore zeolite than the first FCC catalyst stream. The second FCC catalyst stream may comprise a greater proportion of MFI zeolite than the first FCC catalyst stream. The second FCC catalyst stream in the second FCC reactor 42 may contain about 50 to about 100 wt % of the second catalyst. The first catalyst may comprise the balance of the second catalyst stream that is not the second catalyst. The high concentration of the medium or smaller pore zeolite in the second catalyst stream can improve selectivity to light olefins in the second FCC reactor 42. In one exemplary embodiment, the second FCC catalyst can be a MFI zeolite and the second catalyst stream can include about 3 to about 50 wt % MFI zeolite crystal.

The second FCC riser 44 extends upwardly to the bottom of a second reactor vessel 50. The contacting of feed and catalyst is fluidized by gas from a fluidizing line 54. Heat from the catalyst vaporizes the second hydrocarbon feed stream which cracks to lighter molecular weight hydrocarbons in the presence of the second FCC catalyst stream as both are transferred up the second FCC riser 44 into the second reactor vessel 50. The second FCC reactor 42 cracks the HCO down to LCO and cracks naphtha down to light olefins. The second cracked stream of hydrocarbon products and spent catalyst in the riser 44 are thereafter discharged from the riser outlet 44*o* into a disengaging chamber 57 which contains the riser outlet. The second cracked stream of hydrocarbon products is disengaged from the cracking catalyst in the disengaging chamber 57 using a rough cut separator 56. Cyclonic separators which may include one or two stages of cyclones 58 in the reactor vessel 50 further separate catalyst from hydrocarbon products. A second cracked stream of product gases exits the reactor vessel 50 through a product outlet 60 to second product line 62 for transport to a second fractionation column 160.

The second FCC reactor 42 is operated at higher severity than the first FCC reactor 12 to crack the HCO and the naphtha steams. FCC conversion in the second FCC reactor 42 may be at least about 20 wt % and no more than about 60 wt % and may be higher or lower than in the first FCC reactor 12. The outlet temperature of the second cracked products leaving the second riser 44 should be between about 510° C. (950° F.) and about 566° C. (1050° F.) to achieve higher selectivity to LCO and light olefins.

Inevitable side reactions occur in the second riser 44 leaving coke deposits on the catalyst that lower catalyst activity. The spent or coked catalyst requires regeneration for restored activity. Coked catalyst, after separation from the gaseous cracked product hydrocarbons, falls into a stripping section 64 where steam is injected through a nozzle 65 and distributor to purge residual hydrocarbon vapor. After the stripping operation, a portion of the spent catalyst is fed to the catalyst regenerator 70 through a second spent catalyst conduit 66. The catalyst regenerator 70 may be in downstream communication with the second riser 44, specifically, the riser outlet 440.

The second cracked stream in line 62 is isolated from the first cracked stream in line 32. The gaseous second cracked stream in line 62 is fed to the second fractionation column 160 and is fractionated. The second fractionation column 160 is in downstream communication with the second FCC riser 44 and the second FCC reactor 42. Several fractions may be separated and provided from the second fractionation column 160 including a second slurry oil stream from a bottom outlet 170*o* in line 172, a second LCO stream provided in line 174. The second slurry oil stream in line 172 and the second LCO stream in line 174 are isolated from the first cracked stream in line 32. A vaporous second cracked stream comprising naphtha and gaseous light hydrocarbons are removed in an overhead line 162 from the second fractionation column 160 and may be fed to the main fractionation column 90 either with or separate from the first cracked products in line 32. The vaporous second cracked stream may be fractionated with the first cracked stream in the main fractionation column 90. A portion of the LCO stream and the slurry oil streams may be cooled and refluxed back to the second fractionation column 160 to cool it.

The first portion of the spent first catalyst stream in the first spent catalyst conduit 36 and the spent second catalyst in second spent catalyst conduit 66 are fed to the regenerator 70. The first FCC catalyst stream and the second FCC catalyst stream may be regenerated in the same regenerator 70.

FIG. 1 depicts a regenerator 70 known as a combustor. However, other types of regenerators are suitable. In the catalyst regenerator 70, a stream of oxygen-containing gas, such as air, is introduced from line 72 through an air distributor 73 to contact the coked catalyst, burn coke deposited thereon, and provide regenerated catalyst and flue gas. Catalyst and air flow upwardly together from a lower chamber 75 along a combustor riser 77 that has a lower transition section 76 of decreasing inner diameter located within the catalyst regenerator 70 and, after regeneration, are initially separated by discharge through a disengager 78 into an upper chamber 79. Finer separation of the regenerated catalyst and flue gas exiting the disengager 78 is achieved using cyclones 80, within the catalyst regenerator 70. Catalyst separated from flue gas dispenses through diplegs from cyclones 80 while flue gas significantly lighter in catalyst sequentially exits cyclones 80, enter the plenum 82 and exit the regenerator vessel 70 through flue gas outlet 84 in line 86. A regenerated first FCC catalyst stream is recycled back to the first FCC riser 14 through the first regenerated catalyst conduit 18, and a regenerated second FCC catalyst stream is recycled back to the second FCC riser 14 through the second regenerated catalyst conduit 48.

As a result of the coke burning, the flue gas vapors exiting at the top of the catalyst regenerator 70 in line 86 contain CO, $CO_2$ and $H_2O$, along with smaller amounts of other species. Catalyst regeneration temperature is between about 600° C. (1112° F.) and about 900° C. (1652° F.). Both the cracking and regeneration occur at an absolute pressure below about 5 atmospheres.

The first FCC catalyst stream and the second FCC catalyst stream may be isolated from each other even in the regenerator 70 to ensure that the first hydrocarbon feed stream is contacted with the first FCC catalyst stream and the second hydrocarbon stream is contacted with the second FCC catalyst stream. Isolation of the first FCC catalyst stream and the second FCC catalyst stream limits the exposure of the first hydrocarbon stream to the second catalyst comprising medium to smaller pore zeolite which would limit conversion of the heavier hydrocarbon to LCO if allowed in the first FCC reactor 12. A dividing wall 74 extends in the regenerator 70 to isolate the first FCC catalyst stream from the second FCC catalyst stream. In an aspect, the dividing wall 74 may extend from the bottom of the regenerator 70 to the top of the regenerator. In FIG. 1, the wall 74 is shown extending from the bottom of the regenerator 70 in phantom to indicate that the wall 74 does not extend through the distributor 73, but around the distributor. The dividing wall 74 may extend up to the plenum 82 from which flue gas exits the regenerator 70. Other isolation arrangements are contemplated such as a two chamber regenerator in which the first FCC catalyst stream regenerated in one chamber does not enter the other chamber in which the second FCC catalyst stream is regenerated or with a dividing wall that does not extend from top to bottom in the regenerator 70 but substantially isolates the first catalyst stream from the second catalyst stream. For example, the dividing wall 74 in the regenerator 70 may extend from the bottom of the regenerator just up to the top or a little higher than a top of the dense phase such as to the lower end of the transition section 76 to allow dilute phase to insubstantially mix in the dilute phase zone in the upper chamber 79 or upper region of the regenerator 70.

EXAMPLE

In a commercial FCC unit processing 166.1 $m^3$/h (24,319 BPD) of vacuum gas oil feed and utilizing Albemarle AFX catalyst with spent catalyst recycle in which a portion of the spent catalyst was recycled without undergoing regeneration while the other portion of catalyst is regenerated to provide a regenerated catalyst temperature of 730° C. The riser outlet temperature was 545° C. The ratio of catalyst-to-oil which was the sum of recycle and regenerated catalyst to oil fed to the riser was modulated at different levels to test the effect of coke on recycled catalyst on LCO selectivity. Test conditions are shown in the following table. LCO selectivity is the ratio of LCO product flow rate to the sum of the product flow rates of LCO and slurry oil. The average coke on blended catalyst is the weight ratio of coke on catalyst to the total catalyst in the riser.

TABLE

| Coke on Recycled Catalyst, wt % | Catalyst-to-Oil Ratio | LCO Selectivity, wt % | Recycled Catalyst in Riser, wt % | Average coke on blended catalyst, wt % |
|---|---|---|---|---|
| 0.78 | 10.9 | 64.2% | 13.7 | 0.107 |
| 0.99 | 14.8 | 65.9% | 38.5 | 0.381 |
| 1.08 | 17.7 | 66.4% | 47.5 | 0.513 |

Figure 2:
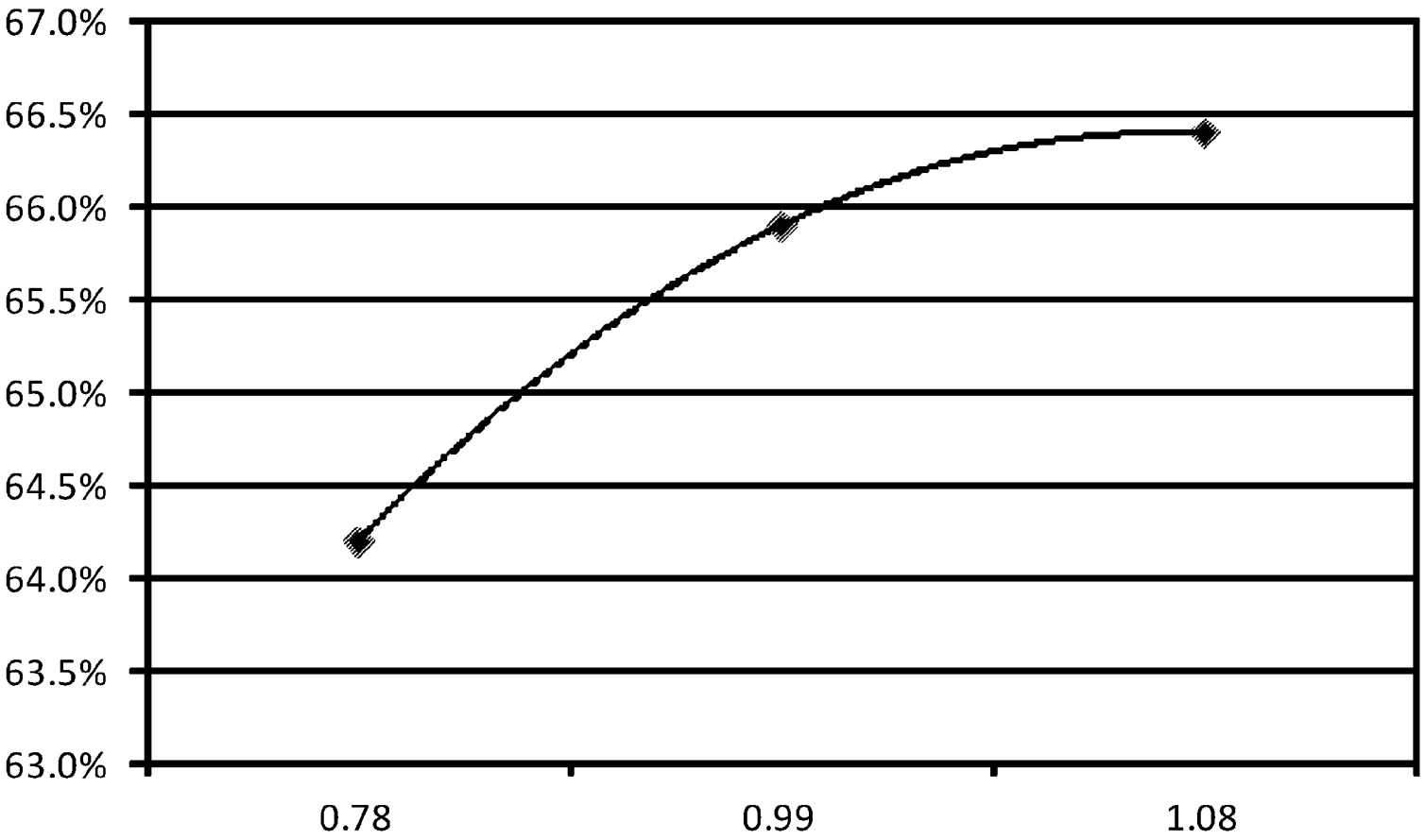
FIG. 2 is a plot of LCO selectivity as a function of coke on recycled catalyst.

FIG. 2 is a plot of LCO selectivity as a function of coke on recycled catalyst. The plot of FIG. 2 shows that coke on recycled catalyst of between about 0.7 and about 1.1 wt % provides greater selectivity to LCO. Particularly, greater than about 0.99 and less than about 1.1 or 1.2 wt % coke on recycled catalyst appears to provide a maximum LCO selectivity.

SPECIFIC EMBODIMENTS

While the following is described in conjunction with specific embodiments, it will be understood that this description is intended to illustrate and not limit the scope of the preceding description and the appended claims.

A first embodiment of the invention is a process for catalytically cracking hydrocarbons comprising contacting a first hydrocarbon feed stream with a first FCC catalyst in a first FCC reactor to provide a first cracked stream; contacting a second hydrocarbon feed stream with a second FCC catalyst in a second FCC reactor to provide a second cracked stream, wherein the second FCC catalyst comprises a greater proportion of MFI zeolite than the first FCC catalyst; fractionating the first cracked stream to provide a heavy cycle oil stream; and recycling the heavy cycle oil stream in the second hydrocarbon feed stream. An embodiment of the invention is one, any or all of prior embodiments in this paragraph up through the first embodiment in this paragraph wherein fractionating the first cracked stream also produces a cracked naphtha stream and further comprising recycling the cracked naphtha stream in the second hydrocarbon stream. An embodiment of the invention is one, any or all of prior embodiments in this paragraph up through the first embodiment in this paragraph wherein fractionating the first cracked stream also produces an LCO stream that is recovered. An embodiment of the invention is one, any or all of prior embodiments in this paragraph up through the first embodiment in this paragraph further comprising taking a portion of the recycle stream from an outlet in a side of a main fractionation column. An embodiment of the invention is one, any or all of prior embodiments in this paragraph up through the first embodiment in this paragraph further comprising isolating the first FCC catalyst from the second FCC catalyst. An embodiment of the invention is one, any or all of prior embodiments in this paragraph up through the first embodiment in this paragraph further comprising regenerating the first FCC catalyst and the second FCC catalyst in the same regenerator. An embodiment of the invention is one, any or all of prior embodiments in this paragraph up through the first embodiment in this paragraph further comprising disengaging the first FCC catalyst from the first cracked stream, regenerating a first portion of the first FCC catalyst and recycling a second portion of the first FCC catalyst to be contacted with the first hydrocarbon feed stream without undergoing regeneration. An embodiment of the invention is one, any or all of prior embodiments in this paragraph up through the first embodiment in this paragraph further comprising fractionating the second cracked stream to provide a second bottoms product that is isolated from the first cracked stream. An embodiment of the invention is one, any or all of prior embodiments in this paragraph up through the first embodiment in this paragraph wherein the second cracked stream provides an LCO stream. An embodiment of the invention is one, any or all of prior embodiments in this paragraph up through the first embodiment in this paragraph wherein fractionating the second cracked stream provides a vaporous second cracked stream that is fractionated with the first cracked stream. An embodiment of the invention is one, any or all of prior embodiments in this paragraph up through the first embodiment in this paragraph wherein the HCO stream has a T5 in the range of about 332° C. (630° F.) to about 349° C. (660° F.) and a T95 in the range of about 382° C. (720° F.) to about 404° C. (760° F.). An embodiment of the invention is one, any or all of prior embodiments in this paragraph up through the first embodiment in this paragraph wherein the second FCC catalyst comprises at least 0.5 wt % MFI crystals. An embodiment of the invention is one, any or all of prior embodiments in this paragraph up through the first embodiment in this paragraph wherein the second FCC catalyst comprises a zeolite to matrix ratio of more than zero and no more than about 2.

A second embodiment of the invention is a process for catalytically cracking hydrocarbons comprising contacting a first hydrocarbon feed stream with a first FCC catalyst in a first FCC reactor to provide a first cracked stream; contacting a second hydrocarbon feed stream with a second FCC catalyst in a second FCC reactor to provide a second cracked stream, wherein the second FCC catalyst comprises a greater proportion of MFI zeolite than the first FCC catalyst; fractionating the first cracked stream to provide a heavy cycle oil stream and a cracked naphtha stream; and recycling the heavy cycle oil stream and the cracked naphtha stream in the second hydrocarbon feed stream. An embodiment of the invention is one, any or all of prior embodiments in this paragraph up through the second embodiment in this paragraph further comprising disengaging the first FCC catalyst from the first cracked stream, regenerating a first portion of the first FCC catalyst and recycling a second portion of the first FCC catalyst to be contacted with the first hydrocarbon feed stream without undergoing regeneration. An embodiment of the invention is one, any or all of prior embodiments in this paragraph up through the second embodiment in this paragraph further comprising isolating the first FCC catalyst from the second FCC catalyst.

A third embodiment of the invention is a process for catalytically cracking hydrocarbons comprising contacting a first hydrocarbon feed stream with a first FCC catalyst in a first FCC reactor to provide a first cracked stream; disengaging the first FCC catalyst from the first cracked stream; regenerating a first portion of the first FCC catalyst; recycling a second portion of the first FCC catalyst to be contacted with the first hydrocarbon feed stream without undergoing regeneration; contacting a second hydrocarbon feed stream with a second FCC catalyst in a second FCC reactor to provide a second cracked stream, wherein the second FCC catalyst comprises a greater proportion of MFI zeolite than the first FCC catalyst; fractionating the first cracked stream to provide a heavy cycle oil stream; and recycling the heavy cycle oil stream in the second hydrocarbon feed stream. An embodiment of the invention is one, any or all of prior embodiments in this paragraph up through the third embodiment in this paragraph wherein fractionating the first cracked stream also produces a cracked naphtha stream and recycling the cracked naphtha stream in the second hydrocarbon stream. An embodiment of the invention is one, any or all of prior embodiments in this paragraph up through the third embodiment in this paragraph wherein fractionating the first cracked stream also produces a cracked naphtha stream and further comprising recycling the cracked naphtha stream in the second hydrocarbon stream.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for catalytically cracking hydrocarbons comprising:

contacting a first hydrocarbon feed stream With a first FCC catalyst in a first FCC reactor to provide a first cracked stream;

contacting a second hydrocarbon feed stream with a second FCC catalyst in a second FCC reactor to provide a second cracked stream, wherein said second FCC catalyst comprises a greater proportion of MFI zeolite than said first FCC catalyst;

fractionating said first cracked stream to provide a heavy cycle oil stream;

recycling said heavy cycle oil stream in said second hydrocarbon feed stream; and fractionating said second cracked stream to provide a second bottoms product that is isolated from the first cracked stream.

2. The process of claim 1 wherein fractionating said first cracked stream also produces a cracked naphtha stream and further comprising recycling said cracked naphtha stream in said second hydrocarbon stream.

3. The process of claim 1 wherein fractionating said first cracked stream also produces an LCO stream that is recovered.

4. The process of claim 1 further comprising taking a portion of said recycle stream from an outlet in a side of a main fractionation column.

5. The process of claim 1 further comprising isolating said first FCC catalyst from said second FCC catalyst.

6. The process of claim 5 further comprising regenerating said first FCC catalyst and said second FCC catalyst in the same regenerator.

7. The process of claim 1 further comprising disengaging said first FCC catalyst from said first cracked stream, regenerating a first portion of said first FCC catalyst and recycling a second portion of said first FCC catalyst to be contacted with said first hydrocarbon feed stream without undergoing regeneration.

8. The process of claim 1 wherein said second cracked stream provides an LCO stream.

9. The process of claim 1 wherein fractionating said second cracked stream provides a vaporous second cracked stream that is fractionated with said first cracked stream.

10. The process of claim 1 wherein said HCO stream has a T5 in the range of about 332° C. (630° F.) to about 349° C. (660° F.) and a T95 in the range of about 382° C. (720° F.) to about 404° C. (760° F.).

11. The process of claim 1 wherein the second FCC catalyst comprises at least 0.5 wt % MFI crystals.

12. The process of claim 1 wherein the second FCC catalyst comprises a zeolite to matrix ratio of more than zero and no more than about 2.

13. A process for catalytically cracking hydrocarbons comprising:

contacting a first hydrocarbon feed stream with a first FCC catalyst in a first FCC reactor to provide a first cracked stream;

contacting a second hydrocarbon feed stream with a second FCC catalyst in a second FCC reactor to provide a second cracked stream, wherein said second FCC catalyst comprises a greater proportion of MFI zeolite than said first FCC catalyst;

fractionating said first cracked stream to provide a heavy cycle oil stream and a cracked naphtha stream;

recycling said heavy cycle oil stream and said cracked naphtha stream in said second hydrocarbon feed stream; and fractionating said second cracked stream to provide a second bottoms product that is isolated from the first cracked stream.

14. The process of claim 13 further comprising disengaging said first FCC catalyst from said first cracked stream, regenerating a first portion of said first FCC catalyst and recycling a second portion of said first FCC catalyst to be contacted with said first hydrocarbon feed stream without undergoing regeneration.

15. The process of claim 13 further comprising isolating said first FCC catalyst from said second FCC catalyst.

16. A process for catalytically cracking hydrocarbons comprising:

contacting a first hydrocarbon feed stream with a first FCC catalyst in a first FCC reactor to provide a first cracked stream;

disengaging said first FCC catalyst from said first cracked stream;

regenerating a first portion of said first FCC catalyst;

recycling a second portion of said first FCC catalyst to be contacted with said first hydrocarbon feed stream without undergoing regeneration;

contacting a second hydrocarbon feed stream with a second FCC catalyst in a second FCC reactor to provide a second cracked stream, wherein said second FCC catalyst comprises a greater proportion of WI zeolite than said first FCC catalyst;

fractionating said first cracked stream to provide a heavy cycle oil stream;

recycling said heavy cycle oil stream in said second hydrocarbon feed stream; and fractionating said second cracked stream to provide a second bottoms product that is isolated from the first cracked stream.

17. The process of claim 16 wherein fractionating said first cracked stream also produces a cracked naphtha stream and recycling said cracked naphtha stream in said second hydrocarbon stream.

* * * * *